US005497555A

United States Patent [19]

Averbukh

[11] Patent Number: 5,497,555

[45] Date of Patent: Mar. 12, 1996

[54] ELECTROMAGNETIC PERCUSSION DEVICE

[76] Inventor: Moshe Averbukh, Moshav Gilat, Karavan 85, D.N. Hanegev 85410, Israel

[21] Appl. No.: 359,149

[22] Filed: Dec. 19, 1994

[51] Int. Cl.[6] ..... B26F 1/00

[52] U.S. Cl. ..... 30/362; 30/277; 30/367; 173/117

[58] Field of Search ..... 30/362, 367, 169, 30/277, 277.4; 173/117

[56] References Cited

U.S. PATENT DOCUMENTS 1,841,781 1/1932 Bisschop et al. ..... 173/117
4,237,987 12/1980 Sherman ..... 173/117

*Primary Examiner*—Douglas D. Watts

*Attorney, Agent, or Firm*—Mark M. Friedman

[57] ABSTRACT

An electromagnetic percussion device, which includes a housing and an instrument which is connected to, and which extends beyond, the housing. The device further includes a piston body reciprocatable within the housing and adapted to impact the instrument. The piston body includes an intermediate region of a first diameter and an enlarged posterior head of a second diameter, with the second diameter being larger than the first diameter. The device also includes a driving member reciprocatable within the housing. The driving member includes a coupling element for slidably accommodating the head of the piston body, thereby coupling the driving member and the piston body together. A permanent magnet is connected to the driving member. Finally, an electromagnet coil is connected to the housing, the coil being operationally coupled to the permanent magnet so as to cause the reciprocation of the driving member.

16 Claims, 4 Drawing Sheets

ELECTROMAGNETIC PERCUSSION DEVICE

FIELD AND BACKGROUND OF THE INVENTION

The present invention relates to percussion machines and, more particularly, to electromagnetic percussion hammers and related devices.

Percussion machines of various designs and sizes are used in a wide range of application, including, but not limited to, construction, mining and various industrial and medical applications.

A typical percussion machine includes a hollow housing through which a piston is reciprocated. The piston periodically impacts an instrument, such as a suitable chisel-like member, which extends beyond the housing. To operate a percussion machine, the distal tip of the instrument is brought into contact with the work piece to be impacted and the percussion machine is activated, causing the piston to reciprocate within the housing and to impact the instrument which transits the shock to the work piece.

Various methods for causing the piston to reciprocate within the housing are available. These include various pneumatic systems which use air pressure to cause the reciprocation of the piston within the housing. A disadvantage of pneumatic percussion hammers is that they must include, or be directly connected to, a source of high pressure air, typically a compressor with its attendant motor. This renders the unit bulky and difficult to transport and thus less versatile in many applications where it is desired to move the unit frequently.

To overcome the above-referenced disadvantage, it has been proposed to drive the piston electromagnetically. In a typical electromagnetic percussion hammer a portion of the housing includes an electromagnet and the piston includes a permanent magnet. The direction of current through the electromagnet is cycled at the desired rate in order to reciprocate the piston. The permanent magnet is attached in some suitable manner to the piston body, which must be made of a non-magnetic material, which greatly limits the materials which can be used and which often forces the use of a material which is less than optimal from the point of view of strength and durability. Typically, the permanent magnet is in the form of a ring which is fixedly embedded in the piston body. A disadvantage of fixedly connecting the permanent magnet to the piston body is that the repeated shocks during operation tend to loosen the connection between the permanent magnet and the piston body and lead to early failure of the device. Furthermore, the non-magnetic portion of the piston needs to be made of two or more parts to allow for assembly and disassembly of the unit which further weakens the unit and reduces its life and reliability.

In an attempt to overcome this difficulty, it has been proposed to mount an annular permanent magnet within an external slot in the piston body in such a way that the magnet is able to travel axially within a confined region defined by an anterior and a posterior portion of the piston body. In such a system arrangements are made to ensure that the two bodies are not in contact with each other at the moment the piston body impacts the instrument. In this way, the impact of the piston body on the instrument is not directly transmitted to the permanent magnet. A difficulty with such a solution is that to assemble a piston unit wherein the piston body forms a confined region through which the annular permanent magnet can travel requires that the piston body be made of at least two portions. This non-monolithic construction is undesirable since the piston body is, as a result, susceptible to failure upon repeated impacts.

There is thus a widely recognized need for, and it would be highly advantageous to have, a highly reliable and durable electromagnetic percussion hammer whose piston body can be made of a single monolithic block of a suitable material.

SUMMARY OF THE INVENTION

According to the present invention there is provided an electromagnetic percussion device, comprising: (a) a housing; (b) an instrument connected to, and extending beyond, the housing; (c) a piston body reciprocatable within the housing and adapted to impact the instrument, the piston body including an intermediate region of a first diameter and an enlarged posterior head of a second diameter, the second diameter being larger than the first diameter; (d) a driving member reciprocatable within the housing, the driving member including a coupling element for slidably accommodating the head of the piston body, thereby coupling the driving member and the piston body together, the coupling element including a plurality of leaves which enclose and confine the head of the piston body when the coupling element is within the housing but which can be moved apart when the coupling element is outside the housing to allow the head of the piston body to be inserted into, or removed from, the coupling element; (e) an electromagnetically active body connected to the driving member; and (f) an electromagnetic coil connected to the housing, the coil operationally coupled to the electromagnetically active body so as to cause the reciprocation of the driving member.

According to another embodiment according to the present invention, there is provided an electromagnetic percussion device, comprising: (a) a housing; (b) an instrument connected to, and extending beyond, the housing; (c) a driving member reciprocatable within the housing, the driving member including an intermediate region of a first diameter and an enlarged anterior head of a second diameter, the second diameter being larger than the first diameter; (d) a piston body reciprocatable within the housing and adapted to impact the instrument, the piston body including a coupling element for slidably accommodating the head of the driving member, thereby coupling the driving member and the piston body together, the coupling element including a plurality of leaves which enclose and confine the head of the driving member when the coupling element is within the housing but which can be moved apart when the coupling element is outside the housing to allow the head of the driving member to be inserted into, or removed from, the coupling element; (e) an electromagnetically active body connected to the driving member; and (f) an electromagnetic coil connected to the housing, the coil operationally coupled to the electromagnetically active body so as to cause the reciprocation of the driving member.

In further alternative embodiments of a percussion device according to the present invention the positions of the electromagnetic coil and electromagnetically active body are reversed.

The present invention successfully addresses the shortcomings of the presently known configurations by providing a electromagnetic percussion machine whose striking piston is made of a single monolithic block of material and which is, as result, more durable and rugged than heretofore comparable devices.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of an electromagnetic percussion hammer. The principles and operation of a percussion hammer according to the present invention may be better understood with reference to the drawings and the accompanying description.

Figure 1:
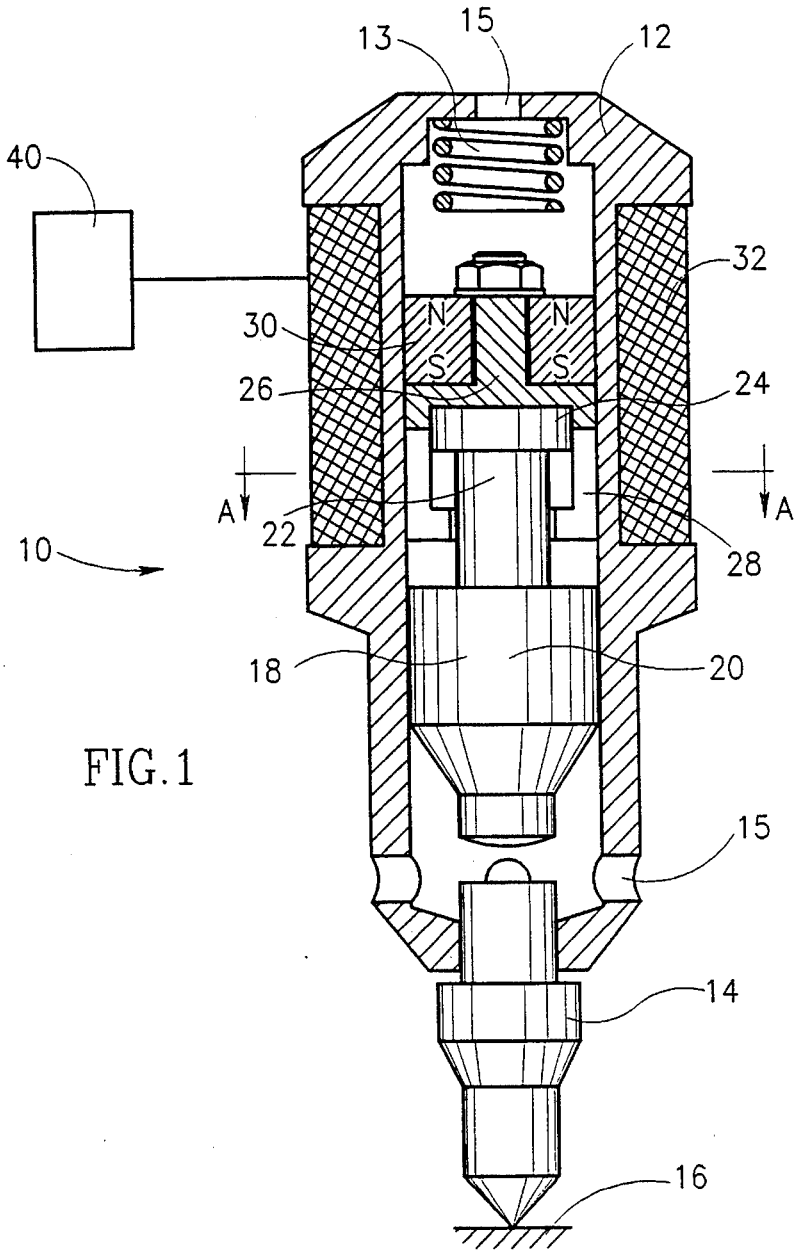
FIG. 1 is a side cross-sectional view of an electromagnetic percussion hammer according to one embodiment of the present invention.
Figure 2:
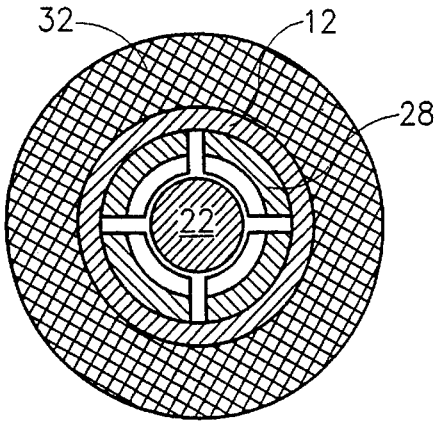
FIG. 2 is an end cross-sectional view of the hammer of FIG. 1 along the section line A—A in FIG. 1.

Referring now to the drawings, FIGS. 1 and 2 illustrate one embodiment of an electromagnetic percussion hammer 10 according to the present invention.

Hammer 10 includes a housing 12. Connected to housing 12 and extending beyond it, is an instrument 14. Instrument 14 may be of any suitable design and may be particularly adapted for specific applications. Thus, for example, instrument 14 in FIG. 1 is a chisel-type member which is designed to impact and break up a substrate 16 on which it operates. As a further example, instrument 14' in FIG. 2 is a cutting tool which is designed to cut into substrate 16. Preferably, housing 12 includes at its posterior end a spring 13. Preferably, housing 12 includes two or more air vents 15. The purpose of spring 13 and of air vents 15 is described below.

Slidably contained within housing 12 is a piston body 18. Piston body 18 is reciprocatable within housing 12 and is adapted to impact instrument 14 so as to impart to instrument 14 a certain momentum which is then, in turn, imparted to substrate 16 being operated upon.

Piston body 18 includes at least three portions or regions—an anterior portion 20, an intermediate region 22 and an enlarged posterior head 24. Anterior portion 20 is at least in part of an outer diameter which is slightly smaller than the inside diameter of housing 12 and serves to center piston body 18 within housing 12. Intermediate region 22 has a certain diameter or diameter-like dimension (hereinafter "diameter"). Enlarged posterior head 24 has a diameter which is larger than the diameter of intermediate region 22 but which is significantly smaller than the inside diameter of housing 12.

Also reciprocatable within housing 12 is a driving member 26. Driving member 26 includes a coupling element 28 for slidably accommodating head 24 of piston body 18, thereby effectively coupling driving member 26 and piston body 18 together, preferably as described in more detail below.

An electromagnetically active body 30, i.e., a body which has properties which enable it to be moved through exposure to an electrical field, is connected to driving member 26. Electromagnetically active body 30 may be a ferromagnetic material or a coil made of any suitable material. Preferably, electromagnetically active body 30 is a permanent magnet and will be referred to as such in the ensuing description and in the Figures, it being understood that the intent is to include any suitable electromagnetically active body.

An electromagnet coil 32 is connected to housing 12, coil 32 being operationally coupled to permanent magnet 30 so as to cause the reciprocation of driving member 26. Thus, by controlling the amount and direction of current through coil 32 it is possible to move permanent magnet 30, and therefore driving member 26 and coupling element 28 axially anteriorly and posteriorly within housing 12.

Coupling member 28 is of a design which allows the ready assembly and disassembly outside housing 12. It is this feature of a device according to the present invention which makes it possible to use a piston body which is made of a single monolithic block of material and which obviates the need to form the piston of two or more blocks. The result is a piston which is more durable and long lasting than those heretofore known.

A preferred design of coupling element 28 is shown in FIGS. 1 and 2 where coupling element 28 is includes a plurality of leaves (FIG. 2 shows four such leaves) which enclose and confine head 24 of piston body 18 when coupling element 28 is within housing 12. The leaves of coupling element 28 can, however, be moved apart, i.e., substantially radially outward, when coupling element 28 is removed from housing 12, thereby allowing head 24 of piston body 18 to be inserted into, or removed from, coupling element 28.

Thus, to assemble a device according to the present invention, prior to insertion of piston body 18 and driving member 26 into housing 12, the leaves of coupling element 28 are forced apart sufficiently to allow head 24 of monolithic piston body 18 to be inserted into coupling element 28. Once head 24 has been thus inserted, the leaves are allowed to resume their normal position. The anterior portions of the leaves feature portions which extend radially inward, thereby preventing head 24 from sliding out of engagement with coupling element 28. When piston head 18 and driving member 26 which are coupled to each other through coupling element 28 as described above are slid into housing 12, the inside walls of housing 12 prevent the leaves of coupling element 28 from moving radially outward. As a result, piston body 18 and driving member 26 are now permanently connected to each other.

Because the axial extent of head 24 is smaller than the axial length of the window formed by coupling element 28, it is possible for head 24 to slide within the window of coupling element 28. The significance of this is described next.

In operation, a device according to the present invention such as that shown in FIGS. 1 and 2 would operate as follows. A control unit 15 controls the supply of current to coil 32. The current flowing in one direction in coil 32 creates a force which tends to push permanent magnet 30 anteriorly. If there is a separation between head 24 of piston body 18 and the posterior portion of coupling element 28, the separation is removed as driving member 26, and coupling element 28 which is attached to it, move anteriorly.

Once head 24 of piston body 18 and the posterior portion of coupling element 28 are touching, further anterior movement of driving member 26 drives piston body 18 anteriorly toward the posterior end of instrument 14.

Prior to impact between the anterior end of piston body 18 and the posterior end of instrument 14, control unit 40 causes the current in coil 32 to switch direction which decelerates the anteriorly-directed motion of driving member 26. Piston body 18 is unaffected by the switch in current direction and continues anteriorly, creating a small gap between itself and driving member 26 so that at the moment piston body 18 strikes instrument 14 there is no direct contact between piston body 18 and driving member 26. As a result, no impact shock is transmitted from piston body 18 to driving member 26 thereby reducing wear on driving member 26 and its permanent magnet 30 and significantly increasing its useful life and reliability.

As driving member moves posteriorly under the influence of the current which now flow in the opposite direction through coils 32, the separation between coupling element 28 and piston body 18 is closed, after which driving member 26 pulls piston body 18 posteriorly. Spring 13 serves to prevent the top of driving member 26 from impacting the top of housing 12, further protecting it from shocks which could adversely affect its reliability.

Once piston body 18 has been lifted sufficiently from instrument 14, control unit 40 again changes the direction of current through coil 32 and the cycle is repeated, bringing about the desired repeated hammering action.

Figure 3:
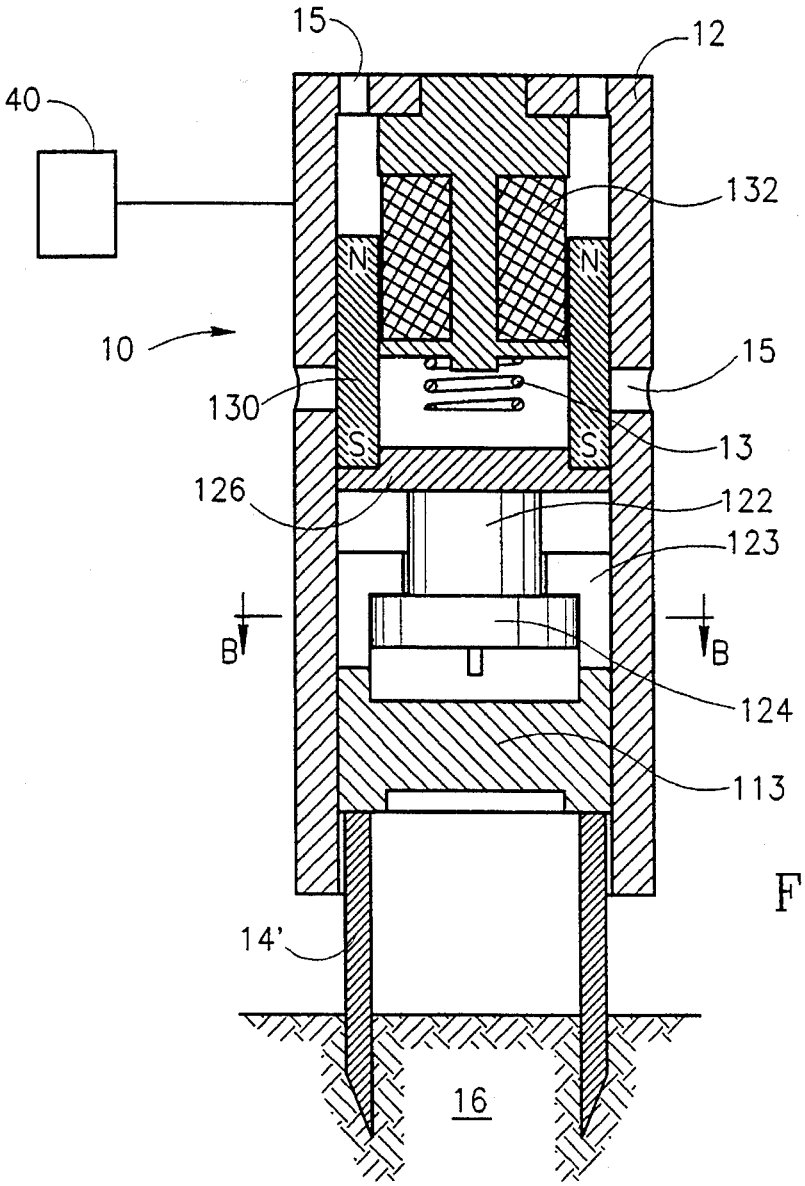
FIG. 3 is a side cross-sectional view of an electromagnetic percussion hammer according to a second embodiment of the present invention.
Figure 4:
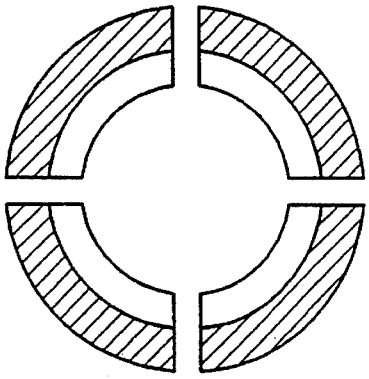
FIG. 4 is an end cross-sectional view of the hammer of FIG. 3 along the section line B—B in FIG. 3.

Another possible configuration of an electromagnetic percussion device according to the present invention is shown in FIGS. 3 and 4. This second embodiment differs from the first (depicted in FIGS. 1 and 2) in a number of ways.

The most important difference is that in the embodiment of FIG. 3 and 4 the coupling element 128 is rigidly connected to piston body 118 rather than to driving member 126. Similarly piston body 118 no longer includes intermediate region 122 and enlarged head 124. Rather, intermediate region 122 and enlarged head 124 are rigidly connected to driving member 126.

Without connection to the above-referenced differences, the embodiment of FIGS. 3 and 4 includes coil 132 which is mounted not on the walls of housing 12, as in the embodiment of FIGS. 1 and 2, but is rather mounted near the center of housing 12 so that permanent magnet 130 which is connected to driving member 126 is disposed radially outward of coils 132.

Figure 5:
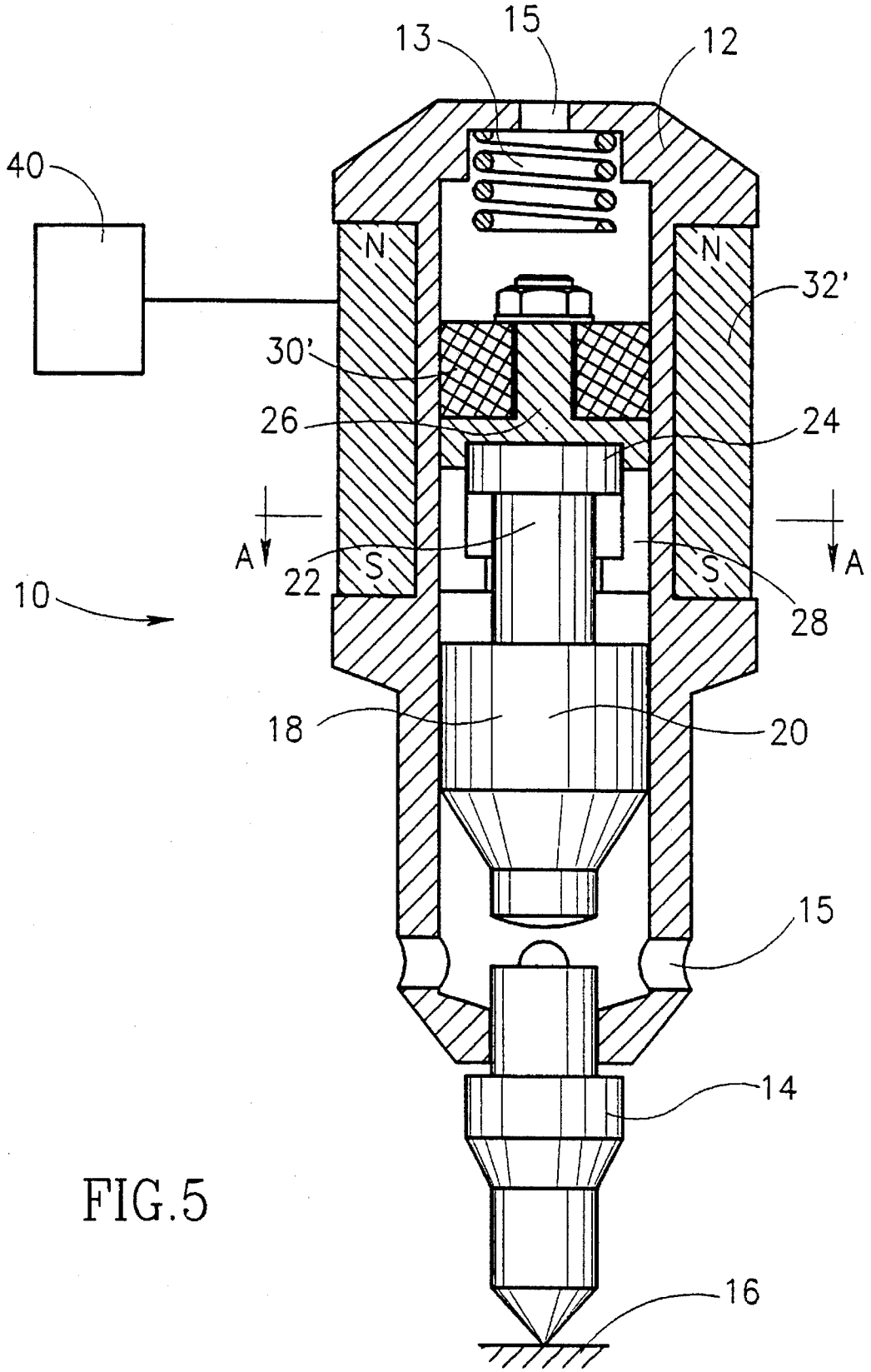
FIG. 5 is a side cross-sectional view of an electromagnetic percussion hammer similar to that shown in FIG. 1 but with the positions of the electromagnetic coil and electromagnetically active body reversed.
Figure 6:
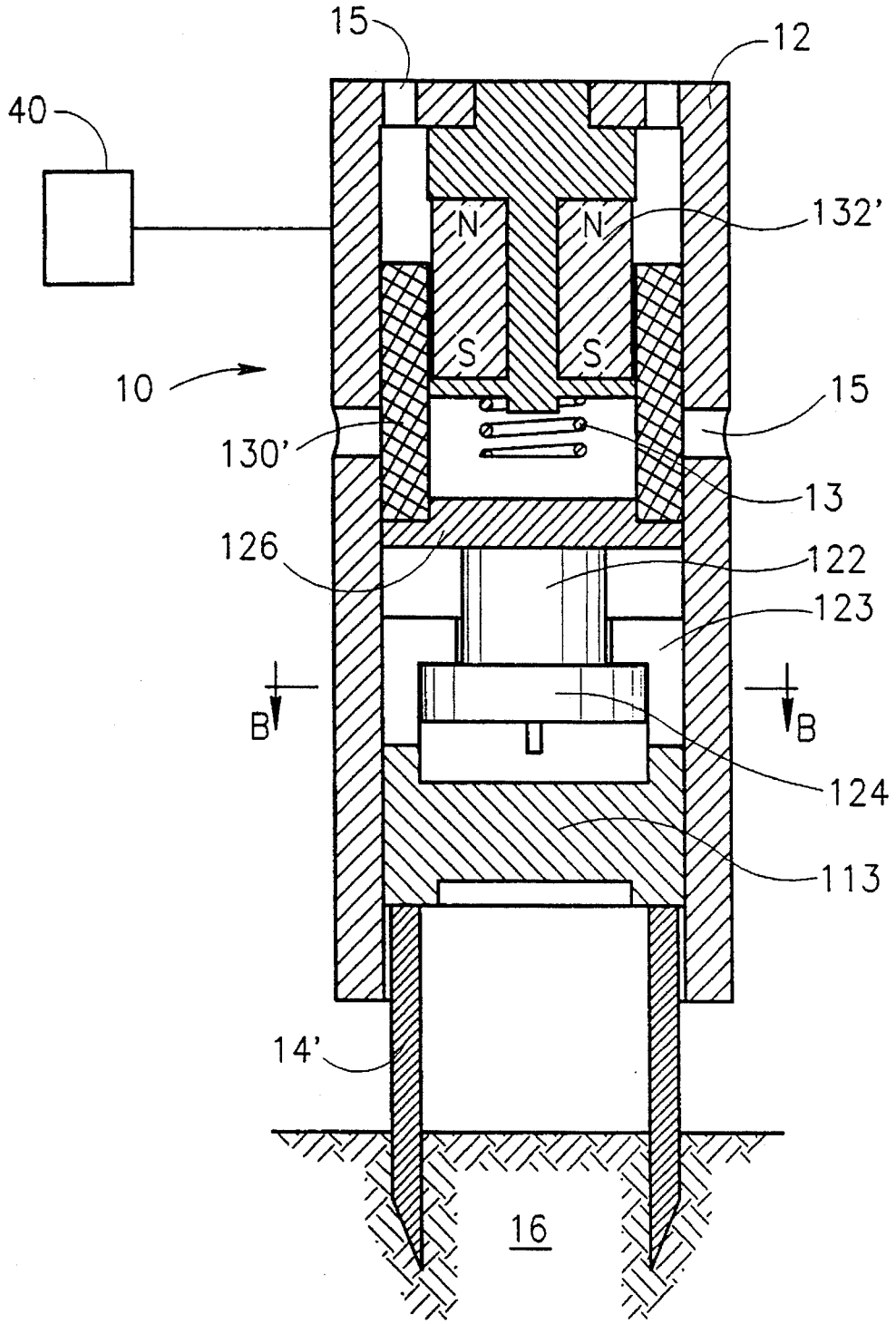
FIG. 6 is a side cross-sectional view of an electromagnetic percussion hammer similar to that shown in FIG. 3 but with the positions of the electromagnetic coil and electromagnetically active body reversed.

Two more alternative embodiments are shown in FIG. 5 and 6 which represent modifications of the two embodiments of FIGS. 1 and 3, respectively. The new embodiments are identical with the earlier described embodiments except for the placement of the electromagnetic coil and the electromagnetically active body which have now been reversed.

Thus, examination of FIG. 5 (corresponding to FIG. 1), shows that the electromagnetic coil 30' is now connected to driving member 26 while electromagnetically active body 32' is now connected to housing 12.

Similarly, as shown in FIG. 6 (corresponding to FIG. 3), the electromagnetic coil 130' is now connected to driving member 126 while electromagnetically active body 132' is now connected to housing 12.

It is also to be noted that connecting electromagnetic coil 30' or 130' to driving member 26 or 126 requires that suitable means be used to provide electrical current to a moving member. This may be achieved by various means, including, but not limited to, the use of brushes (not shown) which is well know from electrical motor applications.

While the invention has been described with respect to a limited number of embodiments, it will be appreciated that many variations, modifications and other applications of the invention may be made.

What is claimed is:

1. An electromagnetic percussion device, comprising:

(a) a housing;

(b) an instrument connected to, and extending beyond, said housing;

(c) a piston body reciprocatable within said housing and adapted to impact said instrument, said piston body including an intermediate region of a first diameter and an enlarged posterior head of a second diameter, said second diameter being larger than said first diameter;

(d) a driving member reciprocatable within said housing, said driving member including a coupling element for slidably accommodating said head of said piston body, thereby coupling said driving member and said piston body together, said coupling element including a plurality of leaves which enclose and confine said head of said piston body when said coupling element is within said housing but which can be moved apart when said coupling element is outside said housing to allow said head of said piston body to be inserted into, or removed from, said coupling element;

(e) an electromagnetically active body connected to said driving member; and (f) an electromagnetic coil connected to said housing, said coil operationally coupled to said electromagnetically active body so as to cause the reciprocation of said driving member.

2. A device as in claim 1, further comprising a spring located at the posterior end of said housing for biasing said driving member anteriorly.

3. A device as in claim 1, wherein said housing includes a plurality of vent holes for venting said housing when said piston body and said driving member reciprocate within said housing.

4. A device as in claim 1, wherein said instrument is a chisel.

5. A device as in claim 1, wherein said instrument is a cutting tool.

6. A device as in claim 1, wherein said electromagnetically active body includes a permanent magnet.

7. A device as in claim 1, wherein said electromagnetically active body includes a coil.

8. A device as in claim 1, wherein said electromagnetically active body includes a ferromagnetic material.

9. An electromagnetic percussion device, comprising:

(a) a housing;

(b) an instrument connected to, and extending beyond, said housing;

(c) a driving member reciprocatable within said housing, said driving member including an intermediate region of a first diameter and an enlarged anterior head of a second diameter, said second diameter being larger than said first diameter;

(d) a piston body reciprocatable within said housing and adapted to impact said instrument, said piston body including a coupling element for slidably accommodating said head of said driving member, thereby coupling said driving member and said piston body together, said coupling element including a plurality of leaves which enclose and confine said head of said driving member when said coupling element is within said housing but which can be moved apart when said coupling element is outside said housing to allow said head of said driving member to be inserted into, or removed from, said coupling element;

(e) an electromagnetically active body connected to said driving member; and (f) an electromagnetic coil connected to said housing, said coil operationally coupled to said electromagnetically active body so as to cause the reciprocation of said driving member.

10. A device as in claim 9, further comprising a spring located at the posterior end of said housing for biasing said driving member anteriorly.

11. A device as in claim 9, wherein said housing includes a plurality of vent holes for venting said housing when said piston body and said driving member reciprocate within said housing.

12. A device as in claim 9, wherein said instrument is a chisel.

13. A device as in claim 10, wherein said instrument is a cutting tool.

14. A device as in claim 9, wherein said electromagnetically active body includes a permanent magnet.

15. A device as in claim 9, wherein said electromagnetically active body includes a coil.

16. A device as in claim 9, wherein said electromagnetically active body includes a ferromagnetic material.

* * * * *